United States Patent [19]

Gasser et al.

[11] 4,140,898

[45] Feb. 20, 1979

[54] CIRCUIT FOR DETECTING DISTURBANCES IN YARN TRAVEL AT A TEXTILE MACHINE

[75] Inventors: Hermann Gasser, Zurich; Karl Curiger, Pfaffikon, both of Switzerland

[73] Assignee: Luwa AG, Zurich, Switzerland

[21] Appl. No.: 868,040

[22] Filed: Jan. 9, 1978

[30] Foreign Application Priority Data

Jan. 20, 1977 [CH] Switzerland ..... 672/77

[51] Int. Cl.[2] ..... G06M 3/02; G07C 3/14

[52] U.S. Cl. ..... 235/92 QC; 235/92 TF; 235/92 PD; 235/92 R; 73/160

[58] Field of Search ..... 235/92 QC, 92 PD, 92 TF, 235/92 PE; 73/160

[56] References Cited

U.S. PATENT DOCUMENTS 3,648,026 3/1972 Fujio Abe et al. ..... 235/92 PD 3,890,489 6/1975 Felix ..... 235/92 PD 4,030,082 6/1977 Goto ..... 235/92 PD

*Primary Examiner*—Joseph M. Thesz

*Attorney, Agent, or Firm*—Werner W. Kleeman

[57] ABSTRACT

A circuit for detecting disturbances in yarn travel at a textile machine, comprising a probe delivering an electrical signal in the presence of such disturbances, the probe being operatively coupled by means of discriminator stages with a pre-selection counter structured for setting the maximum permissable number of disturbances. The pre-selection counter is operatively coupled with a multivibrator which, upon exceeding the aforesaid number, delivers a disturbance signal. A clock generator is coupled with one input of the multivibrator which is constructed as a bistable multivibrator or flip-flop and additionally is connected by means of a delay element with a resetting input of the pre-selection counter.

9 Claims, 4 Drawing Figures

CIRCUIT FOR DETECTING DISTURBANCES IN YARN TRAVEL AT A TEXTILE MACHINE

BACKGROUND OF THE INVENTION

The present invention relates to a new and improved construction of circuit for detecting disturbances in travel of a yarn, thread, filament or the like — hereinafter simply usually referred to as yarn — at a textile machine, comprising a probe delivering an electrical signal in the presence of such disturbances, the probe being coupled by means of discriminator stages at a pre-selection counter structured for setting the maximum permissible number of disturbances and also connected with a multivibrator which, upon exceeding the aforesaid number, delivers a disturbance signal.

SUMMARY OF THE INVENTION

It is a primary object of the present invention to provide a new and improved circuit of the aforementioned type which not only then delivers a disturbance signal when the preset permissable number of disturbances has been absolutely reached or exceeded, but also then when this number has been reached or exceeded within a predetermined period of time. By virtue thereof there is obtained reliable information regarding the yarn travel of the monitored textile machine.

Still a further significant object of the present invention aims at providing a circuit for reliably and accurately detecting disturbances in the travel of a yarn at a textile machine.

Yet a further significant object of the invention is concerned with circuitry for detecting yarn travel disturbances at a textile machine, which circuitry is relatively simple in design, extremely reliable in operation, and not readily prone to malfunction or operational disturbances.

Now in order to implement these and still further objects of the invention which will become more readily apparent as the description proceeds, the circuit of the present development is manifested by the features that the multivibrator is structured as a bistable stage having a clock generator connected with one input thereof, this clock generator being coupled by means of a delay element with a resetting input of the preselection counter.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
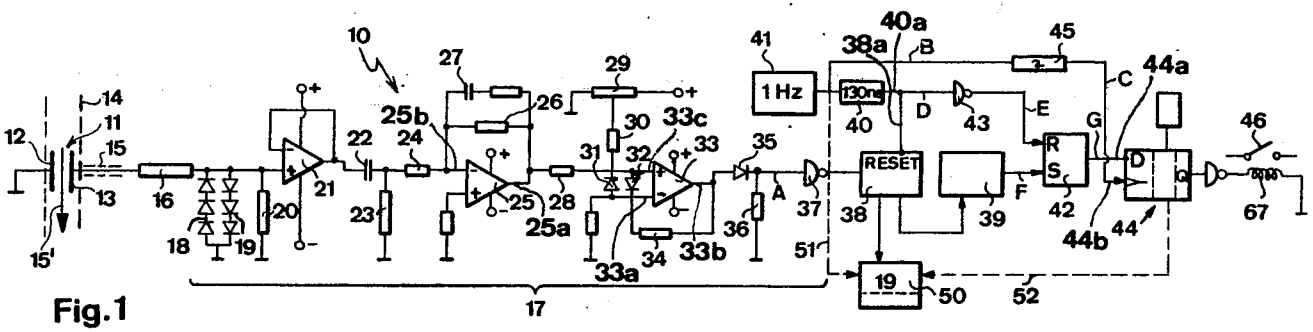
FIG. 1 is a circuit diagram of an exemplary embodiment of circuitry for detecting disturbances in yarn travel at a textile machine as contemplated by the present invention.

Describing now the drawings, the circuit 10 illustrated by way of example in FIG. 1 is coupled with a probe or sensor 11 which, here for the sake of simplicity, has been illustrated as a plate capacitor having a grounded plate 12 and a plate 13 having a floating potential. The probe or sensor 11 is operatively associated for instance with a suction channel 14 of a not particularly illustrated textile machine, which may be for example a preparatory spinning machine or roving frame. In the channel 14 there are sucked-off in the direction of the arrow 15', for instance fiber flocks, lumps or yarn or thread rupture pieces, in other words such finite textile structures which are an indication of disturbances in the yarn travel at the textile machine, such as for instance rupture of the yarn or slubbing. Since this finite textile structure has a dielectric constant differing from that of air, during its movement past the probe 11 there is produced a transient potential change at the plate 13. Also other conditions, such as for instance sucked-up dust, fiber fly or climatic changes in the room where there is housed the relevant textile machine, produce a potential change at the plate 13. Therefore, it is necessary to analyse the superimposed signals, so that there are only evaluated those signals which are predicated upon disturbances which should be detected.

The plate 13 is coupled by means of a screened cable 15 and a protective resistor 16 with discriminator stages generally designated in their entirety by reference character 17, and the purpose of which is to supress or eliminate potential changes which are not predicated upon operational disturbances and to process the remaining potential changes into a digital evaluatable form. These discriminator stages 17 will be seen to first of all comprise two anti-parallel diode chains 18, 19 connected with ground and furthermore a high-ohm leakage resistor 20 (approximately 100 megohms) which, in turn, serve to prevent application of voltage peaks to a subsequently connected impedance converter 21, i.e., to prevent charging thereof. The impedance converter 21 is an operational amplifier in an electrometer circuit which converts the high-ohm voltage fluctuations into low-ohm current fluctuations without any appreciable voltage amplification. Connected in circuit after the impedance converter 21 is a high-pass filter composed of a capactor 22 and a leakage resistor 23. This high-pass filter 22, 23 essentially surpresses frequencies below about 5 Hz. Such extremely low frequencies are for instance attributable to climatic fluctuations or variations. Following the high-pass filter 22, 23 is a coupling resistor 24 and a voltage amplifier 25 having a gain or amplification factor between 5 and 30. The output **25*a* of the amplifier 25 is feedback coupled with its input 25*b* by means of a low-pass filter composed of the resistor 26 and the capacitor 27. This low-pass filter 26, 27 suppresses essentially all frequencies greater than about 1 kHz so that the subsequently arranged coupling resistor 28** essentially can only further conduct signals in a frequency range between about 5 Hz and 1000 Hz.

By means of a potentiometer 29 which is connected between a positive voltage source (+), for instance 12 volts and ground, there is impressed a reference or threshold voltage which can be adjusted between about 5 mV and 300 mV at the inverting input 33*a* of a comparator amplifier 33. This reference or threshold voltage is applied at the input 33*a* of the amplifier 33 by means of the resistor 30 and diode 31. The comparator amplifier 33 is structured such that at its output 33*b* there normally appears a negative rest or quiescent signal of constant potential and only then produces a positive signal of constant potential at such output 33*b* whenever and as long as there appears at the input 33*c* a signal which exceeds the reference or threshold voltage. Hence, the comparator amplifier 33 serves to suppress a noise level of low amplitude which is still present in the remaining frequency band and at the same time to digitialize the signals which, as concerns their amplitude, exceed the noise level. The output 33*b* of the comparator amplifier 33 is feedback coupled by means of a resistor 34 at its non-inverting input 33*c*. Consequently, there is imparted to the characteristic of the amplifier 33 a certain hysteresis in the sense that for producing a positive output signal the input signal must be slightly above the reference or threshold voltage, whereas, conversely, the return to the negative rest signal at the output 33*b* only then occurs when the input signal is somewhat below the reference or threshold voltage.

Figure 2:
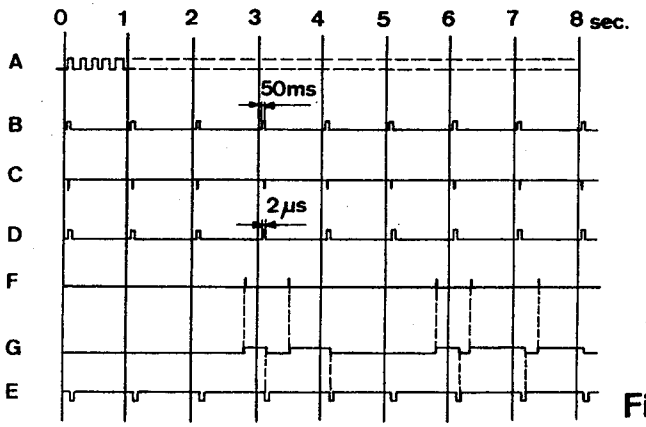
FIG. 2 illustrates characteristic pulse trains which appear during operation at the locations of the circuit of FIG. 1 designated by reference characters A–G.

Connected after the output 33*b* of the comparator amplifier 33 is a diode 35 equipped with a leakage resistor or resistance 36. This diode 35 suppresses the negative part of the output signal of the comparator amplifier 33, so that there is thus available a digitilized signal composed of a sequence or train of pulses of constant amplitude but different duration and having between the pulses pulse pauses or intervals likewise of different duration. Such pulse train which appears at the point A of the circuit of FIG. 1 has been shown in the graph of FIG. 2 at line A. Here it is to be further remarked that each individual one of such pulses is attributable to a disturbance, i.e., to a so-called "interesting event" occurring at the probe or sensor 11.

The thus produced digitalized signal is delivered by means of an inverter or inversion element 37 to a resettable counter 38 coupled with a pre-selection switch 39. The counter 38 for instance can comprise two successively or series-connected binary counting decades.

The resetting input 38*a*, marked "Reset" of the counter 38 is connected by means of a delay element 40 with a clock generator 41. This clock generator 41 determines the duration of the counting periods which, in the embodiment under discussion, amount to one second and produces for this purpose pulses of for instance 50 ms duration having a frequency of 1 Hz, as shown in line B of FIG. 2. The delay or time delay element 40 can be, for instance, a monostable multivibrator responsive to the descending edge of the clock pulses and having a response time of 130 ns and a fixed flop-over or return time of for instance 2 $\mu$s. Thus there appears at the output 40*a* of the delay element 40 whenever such is triggered by a pulse from the clock generator 41, and with a delay of 130 ms after the termination of a clock pulse (which is comparatively disappearingly small in relation to the counting period of one second) a resetting pulse of 2 $\mu$s duration, as such has been illustrated in line D of FIG. 2.

If in a counting period the count of the "interesting events" reaches or exceeds the value set at the preselection switch 39, then at the moment of attainment of such count such produces a short pulse at its output designated by reference character F, this pulse being delivered to the switching or set-input S of a RS flip-flop 42. Such pulses have been illustrated at line F of FIG. 2, namely at the third, fourth sixth, seventh and eighth counting periods from the left of the graph.

The RS flip-flop 42 is a logical switching element which, upon arrival of a logic "1"-signal at its S-input flips over practically without any time delay at its output designated by reference character G from the switching state "0" to the switching state "1" and upon arrival of an inverse "1"-signal at its R-input (reset input) flops over at its output side back into the switching state "0". The R-input of the RS flip-flop 42 is coupled by means of an inversion element 43 with the delay element 40. The corresponding delayed clock signals have been illustrated at line E of FIG. 2.

From the foregoing it should be apparent that if there appears at all at the output G of the flip-flop 42 a logic "1" signal then such disappears at the start of the next following counting period. This is clearly apparent from the showing of line G of FIG. 2, where each pulse at the line F causes a switching or flop over to the switching state "1" at line G and each pulse at the line E causes a switching back to the switching state "0" at line G, provided that the previous switching state was at the peak "1".

Connected with RS flip-flop 42 is a bistable multivibrator or flip-flop 44 behaving like an AND-gate having two inputs 44*a* and 44*b*. As will be explained more fully hereinafter this multivibrator can contain a number of series connected bistable multivibrators or flip-flops, each of which behaves like an AND-gate, and a monostable multivibrator can follow such flip-flop, which monostable multivibrator, triggered by the short output pulses of the preceding flip-flop, can deliver an output pulse of sufficient duration, for instance of 1.5 seconds in order to thus trigger control functions.

As best seen by referring to FIG. 1, the one input 44*a* of the multivibrator 44 is directly connected with the output G of the preceding RS flip-flop 42, whereas the other input 44*b* is connected directly, or, as illustrated by means of a differentiation element 45 with the clock generator 41. The differential element 45 responds without any time-delay to the descending edge of the pulses received from the clock generator 41. The pulses which are delivered by this differentiation element 45 owing to the clock pulses (line B of FIG. 2), have been shown in line C of FIG. 2 and arrive in any event prior to termination of the signal produced in any case at the output G of the RS flip-flop 42, so that there is accomplished a switching-through of the first stage of the flip-flop 44 then and only then when there simultaneously appears at both inputs 44*a* and 44*b* a signal which differs from null.

It is possible to use this first switching-through operation in order to initiate the control functions, for instance switching of a relay contact 46 by means of a coil 67, this contact for instance actuating the cut-off switch of the textile machine. However, it also can be desired not to employ each first, rather only each second switching-through operation for triggering the control functions. This will be explained more fully hereinafter in conjunction with FIG. 4.

From FIG. 1 it will be recognized that a display or indicator device 50 is connected with counter 38, and which for instance can be constructed such there there is continuously displayed during the next following counting period the counter state reached by the counter 38 in one counting period. To this end the display or indicator device 50 can be controlled without any time-delay by means of the control line 51, shown as a broken or phantom line, by the clock generator 41, in order to display the counter state reached by the counter 38 shortly prior to resetting thereof.

On the other hand, the display or indicator device 50 also can be constructed such — and as the same has been indicated by the broken line 52 — that it only indicates or displays that counter state which has produced a disturbance signal, i.e., caused response of the RS flip-flop 42. Those skilled in the art will readily understand and therefore the same has not been further shown, that between a binary counter and a preferably decimal display unit there is required a binary-decimal code converter.

Figure 3:
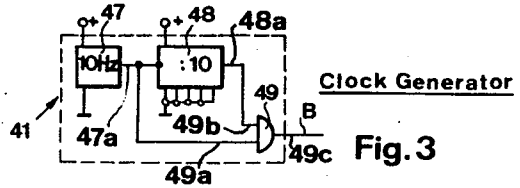
FIG. 3 illustrates an advantageous construction of the clock generator used in the circuit of FIG. 1.

Continuing, it is here mentioned that a possible exemplary construction of a clock generator 41 which can be used with the circuit of FIG. 1 has been shown in detail in FIG. 3. A frequency divider 48 having a dividing or scaling factor of 10 is connected with a RC-oscillator 47 which produces a square wave pulse having a duration of 50 ms and a frequency of 10 Hz. The frequency divider 48 can then be, for instance, a binary decade counter delivering at its output 48*a* a signal after each tenth pulse of the oscillator 47. The output 47*a* of the oscillator 47 and the output 48*a* of the frequency divider 48 are connected with a respective input 49*a* and 49*b* of a coincidence or AND-gate 49. At the output 49*c* of this gate there thus appears only each tenth pulse of the oscillator 47, as illustrated at line B of FIG. 2.

Figure 4:
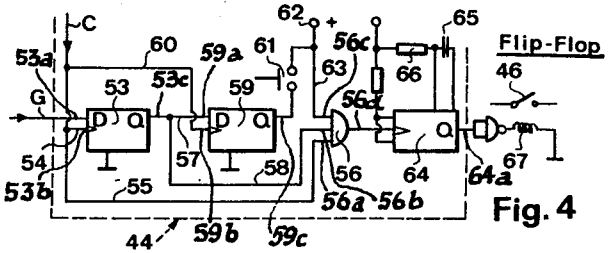
FIG. 4 illustrates an exemplary embodiment of bistable multivibrator or flip-flop which selectively enables further processing the disturbance signal upon its initial occurrence or upon its occurrence in two directly successive counting periods and specifically by means of a monostable multivibrator having a sufficiently long return or flop over time, so that for instance parts of the textile machine can be switched-off or other control functions can be carried out.

In FIG. 4 there is shown a possible exemplary embodiment of the bistable multivibrator or flip-flop 44. The output line or output G of the RS flip-flop 42 is connected with the one input 53*a* of a first D flip-flop 53. The other input 53*b* of flip-flop 53 is connected by means of a line 54 with the output line C of the differentiation element 45. This output line C is also directly connected by means of a further line or conductor 55 with one input 56*a* of the three inputs 56*a*, 56*b*, 56*c* of an AND-gate 46. The output 53*c* of the first D flip-flop 53 is connected by means of a line or conductor 58 at the second input 56*b* of the AND-gate 56 and further by means of the line 57 at the input 59*a* of a second D flip-flop 59, the other input 59*b* of which is connected by means of the line or conductor 60 with the output line C. The output 59*c* of this second D flip-flop is connected by means of a switch 61 with a positive voltage source 62 which, in turn, is connected by means of a line or conductor 63 with the third input 56*c* of the AND-gate 56. The output 56*d* of the AND-gate 56 is connected with a monostable multivibrator or monoflop 64, the return or flop-over time of which can be adjusted by means of a capacitor 65 and a resistor 66 to, for instance, 1.5 seconds. As soon as and as long as a signal is delivered by the AND-gate 56 then the monostable multivibrator 64 delibers at its output 64*a* a signal, which, as shown, can serve to actuate the relay contact 46 by means of the coil or winding 67.

Now if the switch 61 is opened, then there continuously appears at the third input of the AND-gate 56 a logic "1"-signal which is delivered by the direct-current voltage source 62. Now if the first D flip-flop is switched-through then there appears at all three of the inputs 56*a*, 56*b*, and 56*c* of the AND-gate 56, a logic "1"-signal and the monostable multivibrator 64 is triggered.

On the other hand, if the switch 61 is closed, then the current from the voltage source 62 flows low-ohmic to ground by means of the Q-output of the second D flip-flop 59, so that no signal appears at the third input 56*c* of the AND-gate 56. Only upon switching-through of the first D flip-flop 53 will the second D flip-flop 59 also be switched-through, and thus there will be interrupted the connection of its Q-output to ground and only thereafter can there be formed a signal at the third input 56*c* of the AND-gate 56. If at the immediately successive counting period, the D flip-flop 53 again switches-through then the monostable multivibrator 64 will be triggered.

While there are shown and described present preferred embodiments of the invention, it is to be distinctly understood that the invention is not limited thereto, but may be otherwise variously embodied and practiced within the scope of the following claims.

Accordingly, what we claim is:

1. A circuit for detecting disturbances in yarn travel at a textile machine, comprising:

a probe delivering an electrical signal in response to the presence of a yarn travel disturbance;

discriminator stages;

pre-selection counter means having a resetting input and serving for setting the maximum permissible number of said yarn travel disturbances;

said probe being operatively connected by means of said discriminator stages with said preselection counter means;

a bistable multivibrator for delivering a disturbance signal upon exceeding said number of disturbances;

said pre-selection counter means being operatively connected with said bistable multivibrator;

said bistable multivibrator having an input;

a clock generator connected with said input of said bistable multivibrator;

a delay element;

said clock generator being connected by means of said delay element with said resetting input of said pre-selection counter.

2. The circuit as defined in claim 1, wherein: said bistable multivibrator has an input side;

a RS flip-flop connected with said input side of said bistable multivibrator;

said RS flip-flop having a set input (S-input) and a reset input (R-input);

said pre-selection counter means having an output;

said S-input of said RS flip-flop being connected with the output of said pre-selection counter and said R-input being connected by means of said delay element with said clock generator.

3. The circuit as defined in claim 1, wherein:

said delay element comprises a monostable multivibrator having a switching-through time corresponding to the time delay of the delay element.

4. The circuit arrangement as defined in claim 1, wherein:

said clock generator comprises an oscillator and a subsequently connected frequency divider;

said oscillator and said frequency divider each having a rspective output;

and AND-gate having two inputs;

the output of each said oscillator and said frequency divider being connected with a respective one of said inputs of said AND-gate.

5. The circuit as defined in claim 1, wherein:

said bistable multivibrator comprises at least two series connected D flip-flops, each having a resetting input;

said resetting inputs of said two D flop-flops being connected with said clock generator.

6. The circuit as defined in claim 1, wherein:

said bistable multivibrator has a last stage comprising a monostable multivibrator having a flop over time which is greater than a clock period of the clock generator.

7. The circuit as defined in claim 6, wherein:

said bistable multivibrator comprises at least two series connected first and second D flip-flops each having a resetting input and an output;

said resetting inputs of said two D flip-flops being connected with said clock generator;

said monostable multivibrator having an input;

an AND-gate having first, second and third inputs and an output;

a voltage source;

the input of said monostable multivibrator being connected with the output of said AND-gate;

the first of said three inputs of said AND-gate being connected with said clock generator;

the second of said three inputs being connected with the output of the first D flip-flop;

the third of said three inputs being connected with said voltage source; and a switch for connecting said voltage source with the output of the second D flop-flop.

8. The circuit as defined in claim 1, wherein:

the delay time of the delay element amounts to less than 1% of the clock period of the clock generator.

9. A circuit for detecting disturbances in yarn travel at a textile machine, comprising:

means for delivering an electrical signal in response to the presence of a yarn travel disturbance;

discriminator means;

pre-selection means having a resetting input and serving for setting the maximum permissible number of said yarn travel disturbances;

said delivering means being operatively connected by means of said discriminator means with said pre-selection means;

a bistable multivibrator for delivering a disturbance signal upon exceeding said number of disturbances;

said pre-selection means being operatively connected with said bistable multivibrator;

said bistable multivibrator having an input;

a clock generator connected with said input of said bistable multivibrator;

a delay element;

said clock generator being connected by means of said delay element with said resetting input of said pre-selection counter.

* * * * *